US005232112A

United States Patent [19]

Howard

[11] Patent Number: 5,232,112

[45] Date of Patent: Aug. 3, 1993

[54] MOLDED LID FOR RECEIVING HANDLE

[75] Inventor: Gale V. Howard, Blue Springs, Mo.

[73] Assignee: Ruco Products, Inc., Blue Springs, Mo.

[21] Appl. No.: 867,963

[22] Filed: Apr. 13, 1992

[51] Int. Cl.[5] ..... B65D 25/28

[52] U.S. Cl. ..... 220/212.5; 220/768; 220/770

[58] Field of Search ..... 220/212.5, 759, 760, 220/767, 768, 769, 770

[56] References Cited

U.S. PATENT DOCUMENTS

| | | | |
|---|---|---|---|
| 3,044,659 | 7/1962 | Tupper | 220/770 X |
| 3,158,284 | 11/1964 | Henchert et al. | 220/768 X |
| 4,240,554 | 12/1980 | Bock | 206/519 |
| 4,601,406 | 7/1986 | Dudzik | 220/770 X |

*Primary Examiner*—Stephen P. Garbe

*Assistant Examiner*—Nova Stucker

*Attorney, Agent, or Firm*—Hovey, Williams, Timmons & Collins

[57] ABSTRACT

A molded lid for receiving a handle or the like is provided which may be molded of synthetic resin material in straight-pull injection molding machines. The lid includes a lid body presenting a top surface, a bottom surface and a circumscribing upright rim. A pair of opposed ears are tangentially oriented relative to the rim and define therebeneath a gap and therebelow a cavity. The gap is smaller than the cavity, so that a pin of a handle can be retained by the ears against passage through the gap. The gap between the ears enables the lid to be made by straight-pull injection molds so that the cavity-defining portion of the mold can pull through the gap so that the ears initially yield to permit the mold to pass therethrough and then return to their original, molded position.

19 Claims, 1 Drawing Sheet

MOLDED LID FOR RECEIVING HANDLE

BACKGROUND OF THE INVENTION

1. Field of the Invention

This invention relates to a lid which can be inexpensively molded of polyethylene or other synthetic resin to receive a handle or the like. The invention also includes a process for making a lid with an opening extending generally transverse to the pull direction of the mold.

2. Description of the Prior Art

Injection molding of synthetic resins such as polyethylene has made possible the mass production of a variety of articles at a relatively inexpensive cost. The goal of the manufacturer is to produce a quality article at a minimum cost. Aside from material, some of the largest variable costs include labor and tooling.

The most inexpensive mold tooling are simple molds which merely pull apart after the molten polyethylene has been injected therein. These simple molds are generally not capable of producing articles which require holes or other cavities which are oriented transversely to the axis along which the two piece mold is pulled apart. Molded articles made from simple molds and having a transverse hole or cavity have been unable to release from the mold and/or provide a surface with sufficient strength in front of the cavity. As a result, it has heretofore been believed that it was not possible to successfully and commercially mold a lid which included creating an inwardly extending cavity.

Two approaches are generally used to make such holes or cavities. In either approach, the molding machine has included a first component for molding the exposed or top surface of the lid and a second component for molding the rough or bottom surface of the lid. For most lids this second component creates a lip or inwardly projecting thread. The first component of the mold must pull away freely from the lid, and the second component usually includes push pins which push against the lid to free it from the second component. Thus, as the mold separates, the first component pulls free of the lid while the pins associated with the second component push against the back surface of the lid to force the lid free and permit it to fall out of the mold.

In the first approach to creating a cavity extending transversely to the direction of separation of the mold components, a manufacturer may use a side-core pull mold. The side-core pull mold requires much more precision to manufacture and is not only much more expensive to manufacture (about 25 to 30%) but requires a much more expensive molding machine to operate than simple straight-pull molds. Side-pull cores also take up more space than simple molds and thus provide reduced production capacities. In addition, an operator must be continually in attendance because the side-core pull molds are more likely to malfunction which can quickly ruin the expensive mold.

One other way of obtaining holes or cavities which are transverse to the axis along which the mold is pulled apart is to use a simple mold but then drill the hole in the desired location and direction. This method requires the use of an additional operator to drill the holes or cavities and an additional piece of equipment which may cost ten to fifteen thousand dollars.

These additional costs have been particularly aggravating in the production of lids for sun tea jars. These are relatively low cost items but which preferably include a swingable handle so as to present a relatively flat top. A hole is typically provided by one of the two methods outlined above in order to receive the handle with enough strength to support the weight of the jar and its contents, which for a one-gallon jar would be about nine pounds. To provide a hole so that the lids can receive the handle has required the use of expensive side-core pull molds or an additional drilling station when simple straight-pull molds are used. In order to reduce costs, improve efficiency and free workers for more productive tasks, there has developed a need for a lid which includes a cavity capable of receiving a handle but which can be made in a simple mold.

SUMMARY OF THE INVENTION

These problems have largely been solved in accordance with the present invention. That is to say, the lid as disclosed herein can be economically, successfully and commercially produced of thermoplastic synthetic resin using ordinary straight-pull molding machines. The lid hereof successfully separates from the first component of the mold and retains its shape as originally molded, while successfully retaining a handle.

A lid in accordance with the present invention includes a lid body presenting a top surface, a bottom surface, and an upright rim, and may further include a handle pivotally connected therewith. Integrally formed with the lid body is at least one, and preferably two pairs of opposed, tangentially extending ears. Each pair of ears presents a gap therebetween and defines therebeneath a cavity sized to receive the inwardly projecting pins of a handle.

The lid in accordance with the present invention may present a number of different embodiments. For example, the mold forming the top surface of the lid may define a recess area on the side of the ear opposite the gap. This recess may make the ears more resilient and allow the front or first component of the mold to separate more easily. Alternatively, if the use to which the lid is put may make such recesses a sanitation problem, the ears can be molded as solid inwardly projecting ears without a recess therebehind. The cavity may also be provided with a ridge which serves to retain a handle having a pin with a boss at the end thereof from pulling free from the cavity. Finally, in a third illustrated embodiment, the cavity can be formed as an inwardly extending cylindrical cavity, with the ears thereabove presenting generally upright faces so that the gap therebetween presents a slot. In each of the illustrated embodiments, the ears are preferably joined during molding with an upright shoulder defining the inner extent of the cavity. It is believed that this joinder between the shoulder and the ears aids in returning the ears to their originally molded position.

The method of the present invention is surprisingly straightforward. A mold is provided which includes a first component for forming the top surface of the lid. The mold separates the first and second components along an axis of separation. The first component includes a neck and a head which extend into the interior of the mold. The head is larger than the neck in at least one dimension transverse to the direction of extension into the interior of the mold. Synthetic resin in a thermoplastic state is then introduced into the interior of the mold and conforms to the first component of the mold to form a pair of opposed ears separated by the neck. After the synthetic resin has filled the mold and begun to harden, the two components of the mold are separated. During separation, the lid is retained on the second component while the head of the first component pulls through the smaller gap. To permit the head to move therebetween, the ears yield momentarily and then resiliently return to their original molded position. As a result, a cavity is formed where the head of the first component was originally positioned, with the ears returning to their original position to form a gap smaller than the transverse dimension of the cavity. The lid is allowed to cool and harden, thereby giving it the strength to hold a handle in position for such applications as the lid of a sun-tea jar.

DESCRIPTION OF THE PREFERRED EMBODIMENT

Figure 5:
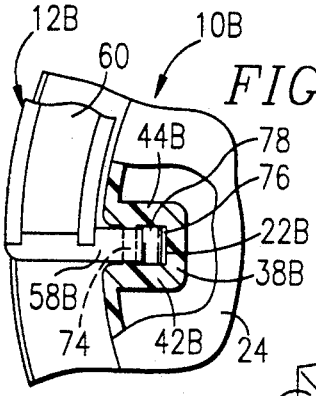
FIG. 5 is a fragmentary top plan view of an alternate embodiment of the lid of the present invention with a portion broken away to reveal the boss of the pin on the handle and the ridge for retaining the boss in the cavity.
Figure 6:
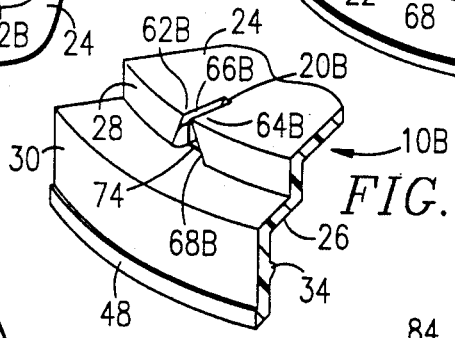
FIG. 6 is a fragmentary perspective view of the embodiment shown in FIG. 5.
Figure 7:
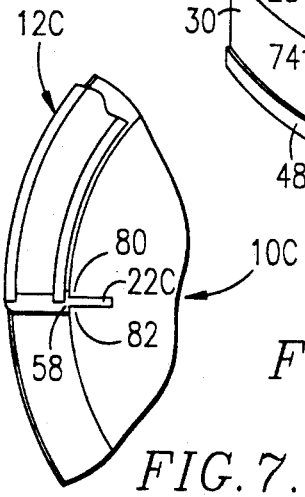
FIG. 7 is a fragmentary top plan view of a third embodiment of the lid of the present invention with the handle in place.
Figure 8:
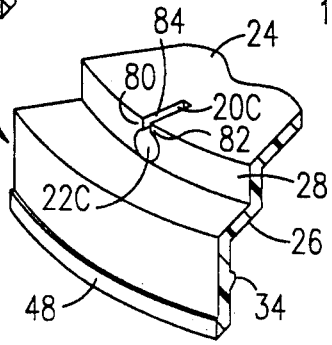
FIG. 8 is a fragmentary perspective view of the embodiment shown in FIG. 7.
Figure 9:
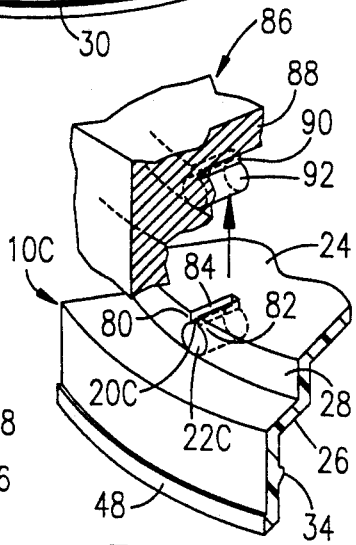
FIG. 9 is a fragmentary perspective view showing the removal of the mold from the lid of FIG. 7 during manufacturing.

Referring now to the drawings, a molded lid 10 for receiving a handle 12 broadly includes a lid body 14, and a pair of opposed ears 16 and 18 integrally formed with the lid body which define a gap 20 therebetween and a cavity 22 therebelow. The lid body 14 and the handle 12 are both preferably formed of a synthetic resin material such as polyethylene. A lid 10 in accordance with the present invention is useful with jars to seal the opening thereof, and may be provided with or without a spout for pouring as is conventional and well-known. The particular lid shown in FIGS. 1 through 4 is identified by the reference character 10A, while the lid shown in FIGS. 5 and 6 is identified by the reference character 10B and the lid shown in FIGS. 7 through 9 is identified by the reference character 10C. It may be understood that like numerals refer to the same aspects of the various embodiments, accompanied by the appropriate letter suffix corresponding thereto.

The lid body 14 is preferably though not necessarily circular in configuration and presents a top surface 24, a bottom surface 26, and a circumscribing, upright rim 28. The lid body as shown in the preferred embodiment also presents a depending sidewall 30 which presents an inner surface 32 having a radially inwardly extending thread 34. The portion of the lid body 14 adjacent to the cavity 22 includes base 36 and upright shoulder 38. Additionally, in the embodiment shown in FIGS. 1 through 4, the lid body 14 also includes side partitions 40 and 42 which are generally upright and extend generally radially outward from shoulder 38 and a pair of fingers 44 and 46 extending generally tangentially from the respective side partitions 40 and 42. A lip 48 circumscribes the bottom edge of sidewall 30. Relief 50 is the open area between ear 16 and side partition 40 and relief 52 is the open area between ear 18 and side partition 42. An annular ledge 54 extends around rim 28 and connects the latter with sidewall 30.

Figure 1:
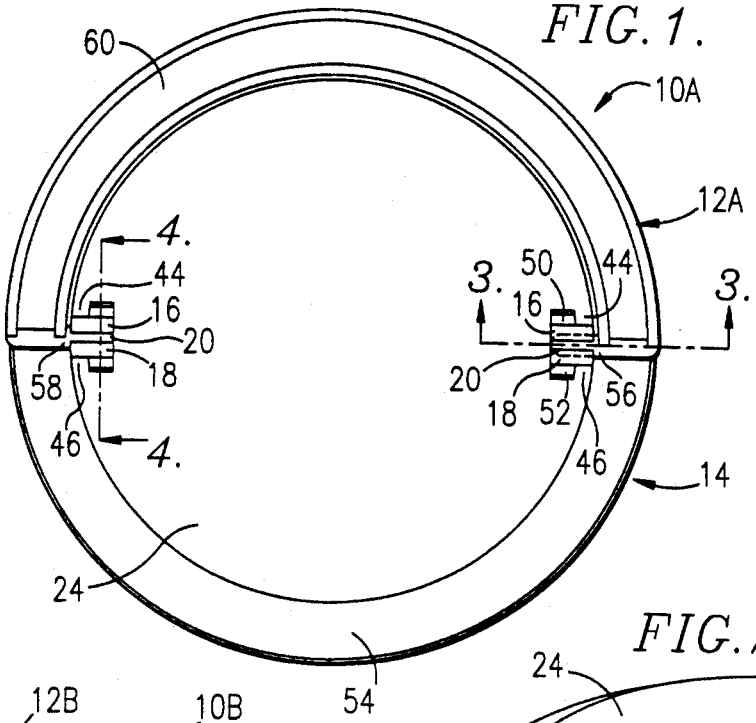
FIG. 1 is a top plan view of a lid in accordance with the present invention showing cavities in the lid for receiving a swingable handle.
Figure 3:
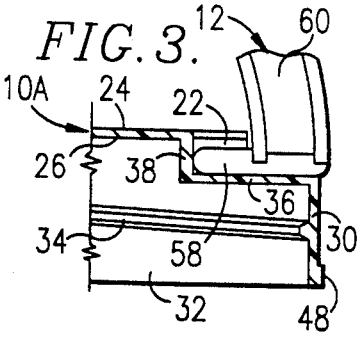
FIG. 3 is an enlarged vertical cross-sectional view taken along line 3—3 of FIG. 1 with the handle in the raised position.

Handle 12 is arcuate in configuration and a pair of opposing, radially inwardly projecting pins 56 and 58 interconnected by bail 60. The pins 56 and 58 are sized to fit into respective cavities 22 as shown in FIGS. 1, 3 and 4, thereby enabling bail 60 to swing upwardly for carrying as shown in FIG. 3 or down around the rim 28 over ledge 54 as shown in FIG. 1.

Figure 4:
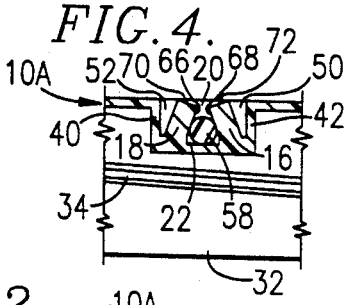
FIG. 4 is an enlarged vertical cross-sectional view taken along line 4—4 of FIG. 1.

In the embodiment of the lid 10A shown in FIGS. 1 through 4, the ears 16 and 18 are angled upwardly and inwardly as shown in FIG. 4 and are thus located intermediate cavity 22 and respective relief 50 or 52. Ears 16 and 18 are opposed and project generally tangentially to the rim 28. Thus, fingers 44 and 46 together with upright shoulder 38 serve to hold the ears 16 and 18 inwardly and prevent pins 56 and 58 from pulling upwardly through gap 20 when the lid and its depending jar are carried by handle 12. On the other hand, during the molding operation, relief 50 and relief 52 provide space to allow ears 16 and 18, then in a thermoplastic state, to yield so as to permit the head of the mold corresponding to cavity 22 to pull through the gap 20 created by the neck of the mold and thus enable the mold to release from the lid 10.

Figure 2:
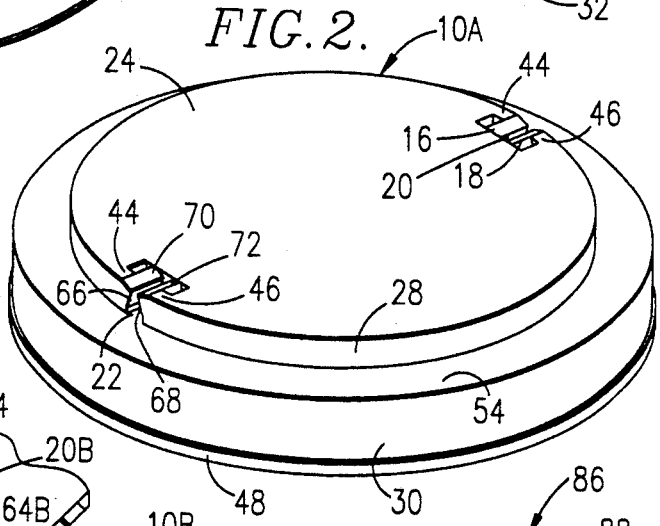
FIG. 2 is a perspective view of the lid shown in FIG. 1 with the handle removed.

In the embodiment shown in FIGS. 1 through 4, ears 16 and 18 each present bevelled surfaces 66 and 68 which face inwardly toward cavity 22 and extend upwardly and inwardly toward gap 20 to define the side walls of the cavity 22. Ears 16 and 18 also present upwardly oriented bevelled surfaces 70 and 72 as shown in FIGS. 2 and 4.

In the embodiment shown in FIGS. 5 and 6, lid 10B has been modified to eliminate fingers 44 and 46 as well as reliefs 50 and 52 and bevelled surfaces 70 and 72 forming a part of the embodiment 10A shown in FIGS. 1 through 4. In the embodiment 10B, ears 62 and 64 present inwardly bevelled surfaces 66B and 68B. Lid 10B still presents gap 20B between ears 62B and 64B which is narrower than the widest dimension of cavity 22B extending in a generally tangential direction to rim 28. When releasing from mold, the head of one component of the mold is able to pull upwardly through ears 62 and 64 while they are thermoplastic and resilient, but the ears nonetheless return to their original position as molded after the head passes therethrough.

In addition, the embodiment shown in FIGS. 5 and 6 includes a raised ridge 74 (shown in phantom in FIG. 5) which extends up and along bevelled surfaces 66B and 68B. The ridge 74 is thus essentially U-shaped and defines radially inwardly thereof an inner pocket 76 within cavity 22B. The width of the ridge may be reasonably narrow, say on the order of about 1/16th inch, and need only be of a very low height in order to hold a boss 78 of the pin 58B of handle 12B within the pocket 76. It should be understood that the diameter of the pin 58 is greater than the distance across gap 20B, but less than the widest dimension across the cavity 22B. Again, the diameter of boss 78 is only somewhat larger than the diameter of pin 58B and, given the resiliency of the bevelled surfaces 66B and 68B, boss 78 is able to snap-fit within pocket 22B.

In the embodiment shown in FIGS. 7, 8 and 9, lid 10C includes ears 80 and 82. The portions of the ears 80 and 82 closest together do not present a bevelled edge as in embodiments 10A and 10B, but present upright faces 84 so that gap 20C is in the form of a slot. Cavity 22C is substantially cylindrical as shown in FIGS. 8 and 9, with the widest dimension of the cavity 22C (oriented tangentially to rim 28) is greater than the width of gap 20C between ear 80 and ear 82.

The process of making the lid 10 is shown with reference to the lid 10C shown in FIG. 9. It should be understood that the process is similar for other embodiments provided the molds are suitably configured. A mold 86 is provided as part of an injection molding machine. The mold 86 includes a first component 88 which forms the exposed surface of the lid 10C include the top surface 24, the upper portion of ledge 54, the outermost faces of rim 28 and sidewall 30, and lip 48. A second component, not shown, is in the shape of the bottom surface 26 of the lid including the faces of the side partitions 40 and 42, base 36, and shoulder 38 which are beneath the top surface 24 and cavity 22. Second component also defines the radially inwardly facing surfaces of rim 28 and sidewall 30, including the thread 34.

First component 88 also includes a neck 90 which is connected to a head 92 which presents a greater or wider dimension transverse to the direction of movement of the first component 88 away from the second component during opening of the mold 86. The direction of movement is generally indicated by the arrow in FIG. 9. Thus, head 92 has a diameter which is greater in a direction tangential to the rim 28 of the lid formed by the mold 86 than the width of the neck 90 in a direction tangential to the rim 28.

Lid 10 is formed when the first component and the second component are together and a thermoplastic synthetic resin such as polyethylene at about 400° Fahrenheit is injected into the interior of the mold between the first and second components. The polyethylene is preferably injected at a pressure of about 4,000 psi and begins to cool, forming the lid 10. As shown in FIG. 9, the first component of the mold 80 then pulls away from the lid 10C in the direction indicated by the arrow. The head 92 of the mold pulls through the gap 20 between the ears of the lid. The ears are still warm and resilient and thus yield to the passage of the head 92 therethrough, but have cooled sufficiently to return to their original, molded positions as illustrated in the figures. The head 92 and neck 90 used to mold the cavity 22B for lid 10B is slightly modified to present a generally triangular shape narrowing at the top to connect with an opposing neck to produce the bevelled surfaces 66B and 68B, with the head including a generally tangentially oriented U-shaped indentation thereon to form the ridge 74. Still, the neck is narrower in the tangential direction than the widest part of the head forming the cavity. The first component of the mold used in making lid 10A is similar to 10B, but also includes nibs projecting into the interior of the mold in a direction generally opposite the arrow shown in FIG. 9 to mold the relief areas 50 and 52 and the neck is generally triangularly shaped to provide for upwardly oriented bevelled surfaces 70 and 72. It may be understood that the method of forming the handles 12A, 12B and 12C is entirely conventional and may be accomplished by standard injection molding techniques to yield a handle of desired dimensions and characteristics.

The first component 88 does not pull the lid 10 off the second component but rather pulls free of the lid, with the lid 10 retained on the second component of the mold. The thread 34 which extends around the inner face of the sidewall 30 is believed to be beneficial in this regard. The second component includes a number of pusher pins as are known to those skilled in the art which force the lid off the second component and leave corresponding marks against, e.g., the bottom side of the lip 48. However, these marks are not readily visible, being on the bottom side of the lip 48, and do not detract from the value of the lid. The lid 10 then falls free of the mold 86 and is permitted to cool to ambient temperature. The handle 12 may thereafter be installed by quickly inserting the pins 56 and 58 into the cavity 22 and the lid is then ready for installation on a jar or jug or other similar use.

Many modifications to the lid and method disclosed herein will be readily apparent to one skilled in the art. For example, various changes in the specific shape of the cavity may be made and still provide a cavity which is wider tangentially than the gap. Thus, it is the intention of this application to take full advantage of the doctrine of equivalents and that the scope of coverage be determined solely with reference to the following claims.

I claim:

1. A lid molded of thermoplastic synthetic resin material defining an inwardly extending cavity therein for receiving a handle, comprising:

a lid body presenting a top surface and a bottom surface and a generally upright rim;

a first ear projecting generally tangentially to said rim and extending therefrom, said first ear being integrally formed with said lid body; and a second ear integrally formed with said lid body and projecting generally tangentially to said rim and extending inwardly therefrom, said second ear being oriented in opposition to said first ear to present a gap therebetween, said gap extending generally upwardly into said top surface, said first ear and said second ear defining a cavity there beneath said cavity communicating with said gap and extending generally inwardly into said rim, said gap between said first ear and said second ear being narrower at its narrowest dimension than said cavity at its widest dimension.

2. A lid as set forth in claim 1, including a generally upright shoulder defining the inward limit of said cavity, said shoulder being inwardly formed with said lid body.

3. A lid as set forth in claim 1, including an upright circular sidewall integrally formed with said body, said sidewall presenting a radially inwardly projecting thread on the inner surface thereof.

4. A lid as set forth in claim 1, wherein said first ear and said second ear each present a bevelled surface facing said cavity.

5. A lid as set forth in claim 4, wherein said first ear and said second ear each present an upwardly beveled surface oriented toward said top surface.

6. A lid as set forth in claim 4, including a recess positioned behind each said first and second ears, whereby said first and second ears are positioned intermediate their respective recesses and said cavity.

7. A lid as set forth in claim 6, wherein said rim is joined to said first and second ears by respective generally tangentially extending fingers.

8. A lid as set forth in claim 1, wherein said first ear and said second ear each present opposing, generally upright faces whereby said gap presents an inwardly extending slot.

9. A lid as set forth in claim 8, wherein said cavity is substantially cylindrically shaped.

10. A lid as set forth in claim 1 presenting a second cavity defined by a second pair of first and second opposing ears on said lid body diametrically opposed to said first cavity.

11. A lid as set forth in claim 1, wherein said cavity is substantially triangularly shaped viewed in vertical section tangentially to said rim.

12. A lid as set forth in claim 1, said cavity including a base and a pair of opposed side walls extending generally upwardly and inwardly toward said gap, said base and said side walls presenting a substantially U-shaped ridge defining an inner pocket in said cavity.

13. A lid as set forth in claim 12, including a handle presenting a radially inwardly oriented pin for extending into said cavity, said pin presenting a boss therein adapted to be received in said inner pocket.

14. A lid molded of theremosplastic synthetic resin material defining an inwardly extending cavity therein for receiving a handle, comprising:

a lid body presenting a top surface and a bottom surface and a generally upright rim;

a first ear projecting generally tangentially to said rim and integrally formed with said lid body;

a second ear integrally formed with said body and projecting generally tangentially to said rim in opposition to said first ear to present a gap therebetween, said first ear and said second ear defining a cavity therebeneath extending generally inwardly into said rim, said gap between said first ear and said second ear being narrower at its narrowest dimension than said cavity at its widest dimension; and a recess located in said body and positioned behind each said first and second ears, whereby said first and second ears are positioned intermediate their respective recess and said cavity.

15. A lid as set forth in claim 14, wherein said rim is joined to said first and second ears by respective generally tangentially extending fingers.

16. A lid as set forth in claim 15, including an upright circular sidewall integrally formed with said body, said sidewall presenting a radially inwardly projecting thread on the inner surface thereof.

17. A lid molded of theremosplastic synthetic resin material defining an inwardly extending cavity therein for receiving a handle, comprising:

a lid body presenting a top surface and a bottom surface and a generally upright rim;

a first ear projecting generally tangentially to said rim and integrally formed with said lid body;

a second ear integrally formed with said body and projecting generally tangentially to said rim in opposition to said first ear to present a gap therebetween, said first ear and said second ear defining a cavity therebeneath extending generally inwardly into said rim, said gap between said first ear and said second ear being narrower at its narrowest dimension than said cavity at its widest dimension; and a recess located in said body and positioned behind each said first and second ears, whereby said first and second ears are positioned intermediate their respective recess and said cavity, and said cavity including a base and a pair of opposed side walls extending generally upwardly and inwardly toward said gap, said base and said side walls presenting a substantially U-shaped ridge defining an inner pocket in said cavity.

18. A lid as set forth in claim 17, including a handle presenting a radially inwardly oriented pin for extending into said cavity, said pin presenting a boss therein adapted to be received in said inner pocket.

19. A lid as set forth in claim 18, including an upright circular sidewall integrally formed with said body, said sidewall presenting a radially inwardly projecting thread on the inner surface thereof.

* * * * *